US008585321B2

(12) United States Patent
Moody

(10) Patent No.: US 8,585,321 B2
(45) **Date of Patent: *Nov. 19, 2013**

(54) FLOW CONTROL SYSTEM FOR A DETENTION POND

(75) Inventor: Jonathan D. Moody, New Port Richey, FL (US)

(73) Assignee: Thirsty Duck, LP, New Port Richey, FL (US)

( * ) Notice: Subject to any disclaimer, the term of this patent is extended or adjusted under 35 U.S.C. 154(b) by 737 days.

This patent is subject to a terminal disclaimer.

(21) Appl. No.: 12/816,397

(22) Filed: Jun. 16, 2010

(65) Prior Publication Data

US 2010/0284746 A1 Nov. 11, 2010

Related U.S. Application Data

(63) Continuation-in-part of application No. 12/463,614, filed on May 11, 2009, now Pat. No. 7,762,741.

(51) Int. Cl.
*E02B 3/00* (2006.01)

(52) U.S. Cl.
USPC ..... 405/96; 405/41; 137/578

(58) Field of Classification Search
USPC ..... 405/41, 80, 96, 97; 137/578
See application file for complete search history.

(56) References Cited

U.S. PATENT DOCUMENTS

| | | | | |
|---|---|---|---|---|
| 706,526 | A | 8/1902 | Carlisle | |
| 1,758,941 | A | 5/1930 | Gibson | |
| 2,882,928 | A | 4/1959 | Cogliati | |
| 3,311,129 | A | 3/1967 | Binder | |
| 3,832,854 | A | 9/1974 | Metts | |
| 4,015,629 | A | 4/1977 | Morgan et al. | |
| 4,094,338 | A | 6/1978 | Bauer | |
| 4,224,156 | A | 9/1980 | Pardikes et al. | |
| 4,718,449 | A | 1/1988 | Ralph | |
| 5,133,854 | A | 7/1992 | Horvath | |
| 5,498,348 | A | 3/1996 | Plink | |
| 5,820,751 | A | 10/1998 | Faircloth, Jr. | |
| 6,997,644 | B2 | 2/2006 | Fleeger | |
| 7,125,200 | B1 | 10/2006 | Fulton | |
| 7,186,058 | B2 | 3/2007 | Schluter | |
| 7,429,147 | B2 | 9/2008 | Marchetti | |
| 7,762,741 | B1 | 7/2010 | Moody | |
| 7,985,035 | B2 * | 7/2011 | Moody | 405/96 |
| 8,043,026 | B2 * | 10/2011 | Moody | 405/96 |
| 2011/0176869 | A1 * | 7/2011 | Moody | 405/96 |

* cited by examiner

*Primary Examiner* — Frederick L Lagman

(74) *Attorney, Agent, or Firm* — Larson & Larson, P.A.; Frank Liebenow; Justin P. Miller

(57) ABSTRACT

An application for a flow control system includes a movable riser in fluid communication and slideably engaged with a stationary riser, the stationary riser being in fluid communication with a drainage system. The movable riser is made buoyant by one or more attached floats such that, when the liquid level around the flow control system increases to a pre-determined level, the movable riser lifts due to the buoyancy of the float(s), thereby maintaining the pre-determined displacement as the water level continues to rise, yielding either a constant flow rate or a variable, predictable flow rate through the drainage system.

19 Claims, 6 Drawing Sheets

FLOW CONTROL SYSTEM FOR A DETENTION POND

CROSS-REFERENCE TO RELATED APPLICATION

This application is a Continuation-in-part of U.S. patent application Ser. No. 12/463,614, filed May 11, 2009, and inventor Jonathan D. Moody. This application is related to U.S. patent application Ser. No. 12/570,734, filed Sep. 30, 2009, and inventor Jonathan D. Moody. This application is also related to U.S. patent application Ser. No. 12/570,756, filed Sep. 30, 2009, and inventor Jonathan D. Moody.

FIELD OF THE INVENTION

The disclosure relates to the field of flow control devices and more particularly to a flow control device for a detention pond or surge tank.

BACKGROUND

Detention ponds and surge tanks are deployed to temporarily store a fluid and limit the rate of fluid discharge to a downstream system when the inflow rate of the fluid is variable at times exceeds the functional capacity of the downstream system. In the case of a storm water detention pond, the pond receives increased rates of storm water runoff generated by the development of upstream lands, temporarily stores the runoff and limits the rate of discharge of the runoff to a receiving system of water conveyance such as a river, stream or storm sewer such that the capacity of the receiving system is not exceeded thereby causing flooding, harmful erosion or other environmental damage. Similarly, a surge tank temporarily stores a process fluid of varying inflow rate and limits the rate of discharge of the fluid to that which will not exceed the capacity of a downstream process. In the field of wastewater treatment, a surge tank may be deployed to receive wastewater flows during peak periods of water use, temporarily store the wastewater and limit the release of the wastewater flow to the treatment plant to a rate not exceeding the design capacity of the plant.

The temporary storage volume required for a detention pond or surge tank is dependent on the rate and duration of fluid inflow and the allowable rate and duration of fluid outflow. The larger the difference between the peak rate of inflow and the allowable rate outflow, the greater the volume is required for temporary storage. Whereas providing large storage volumes can be costly such as the expense incurred for land acquisition and excavation required to construct a large detention pond or the expense of fabrication and installation of a very large tank it is therefore advantageous to minimize the amount of temporary storage volume required for safe operation of the system. Minimization of the temporary storage volume required can be accomplished by minimizing the difference between the duration and rate of inflow and the duration and rate of outflow. Since the rate inflow is variable and cannot be controlled, minimization of the required temporary storage volume is achieved when the maximum allowable rate of discharge is sustained for the longest possible duration of time.

The prior art is generally concerned with limiting the maximum outflow rates, at which damage can occur, by employing discharge control mechanisms such as fixed weirs, orifices, nozzles and riser structures whereby the maximum discharge rates of such mechanisms are determined by the geometric configuration of the mechanisms and the height of the fluid or static head acting on the mechanisms. In each case, the maximum flow rate is achieved only at the single point in time at which the static head acting on the mechanism is at its maximum level. Therefore, all discharges occurring when fluid levels are not at their maximums are less than optimum.

One solution to this problem is described in U.S. Pat. No. 7,125,200 to Fulton, which is hereby incorporated by reference. This patent describes a flow control device that consists of a buoyant flow control module housing an orifice within an interior chamber that is maintained at a predetermined depth below the water surface. This flow control device neglects the use of other traditional flow control mechanisms such as weirs, risers and nozzles, has limited adjustability, and utilizes flexible moving parts subject to collapse by excess hydrostatic pressure or failure resulting from material fatigue caused by repeated cyclical motion.

What is needed is a flow control device that provides for deployment of a variety of discharge control mechanisms in singular or in combination, is readily adjustable to accommodate for deviations incurred during installation, settlement, or by variability in the weights and densities of the materials of which it is comprised and does not rely on parts subject to failure by excess hydrostatic force or repeated cyclical motion while maintaining a nearly constant rate of discharge at varying fluid levels.

SUMMARY OF THE INVENTION

A flow control system of the present invention includes a movable riser slideably engaged with a stationary riser. The stationary riser is interfaced to a downstream drainage system. The movable riser is made buoyant by one or more floats attached to the movable riser such that, when the water level around the flow control system increases to a pre-determined level above a top rim of the movable riser, the movable riser lifts due to the buoyancy of the float(s), thereby maintaining the pre-determined level, even as the water level continues to rise.

In one embodiment, a flow control system for integration into a detention pond or surge tank is disclosed including a stationary riser having a hollow core, an axis of which is vertical. The hollow core of the stationary riser is fluidly connected to a downstream drainage system. A movable riser is slideably interfaced with the stationary riser and also has a hollow core, an axis of which is also vertical. A rim is at the top surface of the movable riser. The hollow core of the movable riser is fluidly connected to the hollow core of the stationary riser so that water from the detention pond or liquids from the surge tank flow over the rim, through the hollow core of the movable riser through the hollow core of the stationary riser and into the downstream drainage system. At least one float is interfaced to the movable riser, providing buoyancy to the movable riser and maintaining the rim at fixed distance below the fluid surface.

In another embodiment, a flow control system for integration into a detention pond or surge tank is disclosed including a stationary riser having a hollow core, an axis of which is vertical. The hollow core is fluidly connected to a downstream drainage system. A movable riser is slideably interfaced with the stationary riser and also has a hollow core with an axis that is also vertical. A single nozzle or combination of nozzles or similar or differing geometries, an axis of which is vertical and fashioned to fit over the rim of the movable riser, is fluidly connected to the hollow core of the movable riser and the hollow core of the movable riser is fluidly connected to the hollow core of the stationary riser whereas water from the detention pond or liquid from the surge tank flows through the nozzle, through the hollow core of the movable riser through the hollow core of the stationary riser and out of hollow core of the stationary riser and into the downstream drainage system. At least one float is interfaced to the movable riser, providing buoyancy and maintaining the nozzle at a fixed distance below the fluid surface.

In another embodiment, a flow control system for integration into a detention pond or surge tank is disclosed including a stationary riser having a hollow core, an axis of which is vertical. The hollow core is fluidly connected to a downstream drainage system. A movable riser is slideably interfaced with the stationary riser and also has a hollow core with an axis that is also vertical. A single nozzle or combination of nozzles of similar or differing geometries, an axis of which is horizontal and penetrate the vertical surface of the movable riser, is fluidly connected to the hollow core of the movable riser and the hollow core of the movable riser is fluidly connected to the hollow core of the stationary riser whereas water from the detention pond or liquid from the surge tank flows through the nozzle, through the hollow core of the movable riser through the hollow core of the stationary riser and out of hollow core of the stationary riser and into the downstream drainage system. At least one float is interfaced to the movable riser, providing buoyancy and maintaining the nozzle at a fixed distance below the fluid surface.

In another embodiment, a flow control system for integration into a detention pond or surge tank is disclosed including a stationary riser having a hollow core, an axis of which is vertical. The hollow core is fluidly connected to a downstream drainage system. A movable riser is slideably interfaced with the stationary riser and also has a hollow core with an axis that is also vertical. A notch or combination of notches with similar or differing geometries fashioned below the rim and through the vertical surface of the movable riser, is fluidly connected to the hollow core of the movable riser and the hollow core of the movable riser is fluidly connected to the hollow core of the stationary riser whereas water from the detention pond or liquid from the surge tank flows through the notch, through the hollow core of the movable riser through the hollow core of the stationary riser and out of hollow core of the stationary riser and into the downstream drainage system. At least one float is interfaced to the movable riser, providing buoyancy and maintaining the notch at a fixed distance below the fluid surface.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
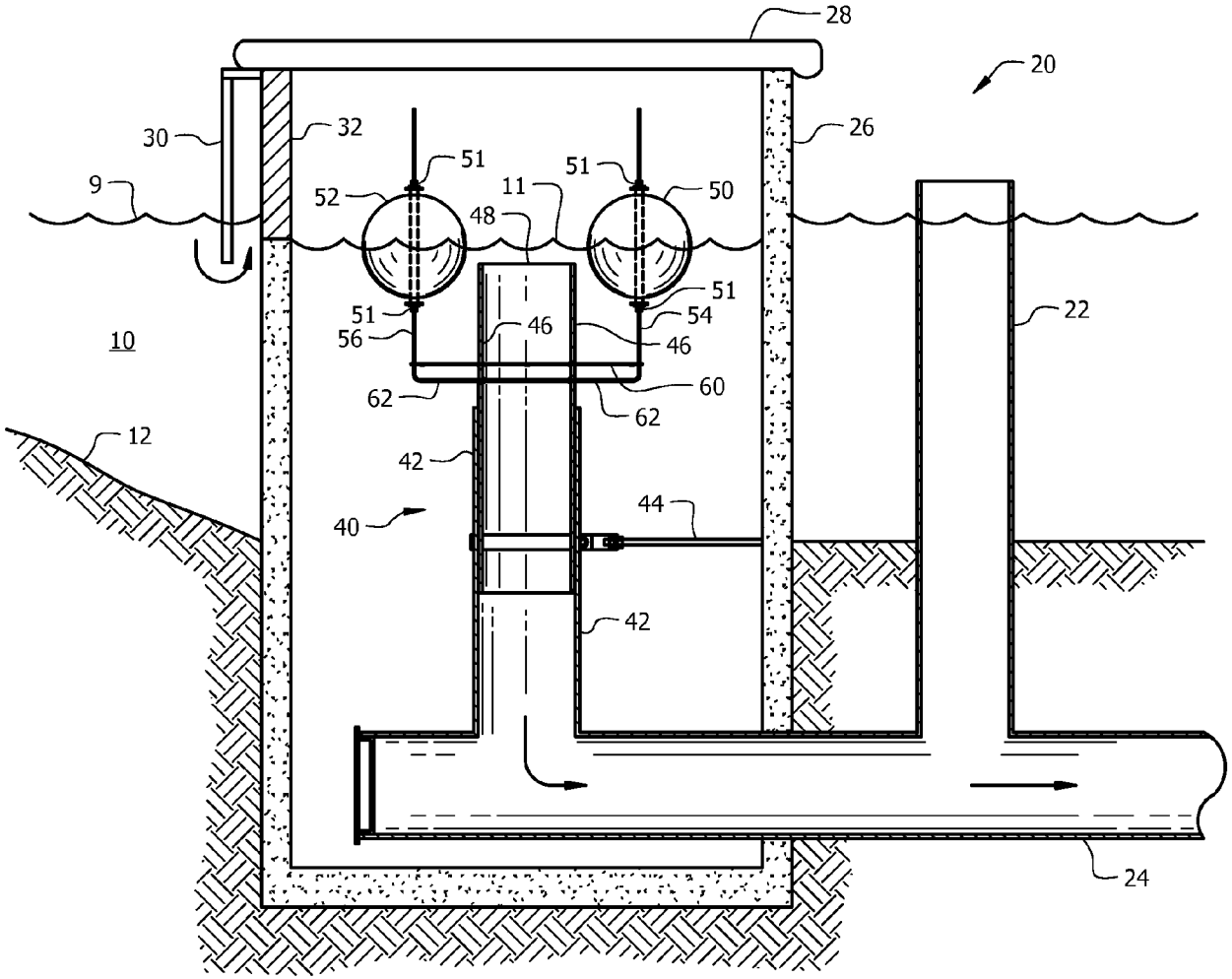
FIG. 1 illustrates a schematic view of a system of the present invention.

Reference will now be made in detail to the presently preferred embodiments of the invention, examples of which are illustrated in the accompanying drawings. Throughout the following detailed description, the same reference numerals refer to the same elements in all figures. Throughout the following description, the term detention pond and surge tank represent any such structure and are equivalent structure for detaining liquids.

The flow control system described provides for an initial discharge rate starting as soon as the detention pond or surge tank reaches a pre-determined liquid level, then, as the liquid level increases, the discharge rate and the down-stream water pressure remain relatively constant until a high-water level is reached, at which level the flow control system provides for an increased discharge rate to reduce the possibility of exceeding the volumetric capacity of the detention pond or surge tank.

Prior to more advanced flow control systems, limiting the maximum outflow rates, at which damage can occur, was accomplished by deploying discharge control mechanisms such as fixed weirs, orifices, nozzles and riser structures whereby the maximum discharge rates of such mechanisms are determined by the geometric configuration of the mechanisms and the height of the fluid or static head acting on the mechanisms. In each case, the maximum flow rate is achieved only at the single point in time at which the static head acting on the mechanism is at its maximum level. Therefore, all discharges occurring when fluid levels are not at their maximums are less than optimum and require provision of greater temporary storage capacities. The present invention solves these and other problems as is evident in the following description.

Referring to FIG. 1, a schematic view of a system of the present invention will be described. The detention pond or surge tank flow control system 20 has two primary components, a holding box 26/28/30 and the actual flow control device 40.

The holding box 26/28/30 consists of a holding box 26, typically made of concrete and having a lid 28, typically made of concrete or metal. A debris shield 30 partially covers an opening 32 in the side of the box 26. The holding box 26/28/30 is positioned part way into the bed 12 of the detention pond or bottom of the surge tank 10. As the liquid level 9 in the detention pond or surge tank 10 rises, it is skimmed by the debris shield 30, holding back some or all of any floating debris, oil, etc, and allowing liquid from the detention pond or surge tank to spill over into the holding box 26.

The flow control device 40 consists of a stationary riser 42 and a movable riser 46. The movable riser 46 is supported by floats 50/52 such that, as liquid begins to rise within the holding box 26, the floats become buoyant and lift the movable riser 46, maintaining a constant water depth over the top rim 48 of the movable riser 46. Once the liquid level 11 within the holding box 26 rises above the top rim 48, liquid flows over the top rim 48 at a constant rate independent of the liquid level of the detention pond or surge tank 10 because the top rim 48 is held at approximately the same depth beneath the liquid surface 11 within the holding box 26. The liquid flows through the stationary riser 42 and out the drain pipe 24 to the drainage system, streams, rivers, etc. in the case of a storm water detention pond or downstream process in the case of a surge tank.

The movable riser 46 and the stationary riser 42 have hollow cores and the hollow cores run vertically to accept liquid from the detention pond or surge tank 10 and transfer the liquid from the holding pond 10 to a down-stream drainage system 24. The movable riser 46 hollow core accepts liquid flowing over the rim 48 from the detention pond or surge tank and passes it into the stationary riser 42 hollow core. The stationary riser 42 hollow core passes the liquid to the drain pipe 24 and out to the drainage system, streams, rivers, etc. in the case of a storm water detention pond or downstream process in the case of a surge tank.

In some embodiments, the floats 50/52 are mounted on float shafts 54/56. In such embodiments, optionally, the float shafts 54/56 extend upward beyond the floats 50/52 to provide a maximum lift height for the movable riser 46. In this, as the liquid level 11 rises within the holding box 26 to a high point, the tops of the float shafts 54/56 hit the cover 28, thereby preventing further lifting of the movable riser 46. This accomplishes at least two functions: it prevents the movable riser 46 from disengaging with the stationary riser 42 and it allows a greater flow rate during emergency situations—when the detention pond or surge tank 10 over-fills. In addition, also anticipated is a bypass drain 22, which begins bypassing water when the liquid in the detention pond or surge tank 10 reaches a certain height.

Although there are many ways to interface the floats 52/54 with the movable riser 48, shown is a pair of float shafts 54/56. In one embodiment, the float shafts 54/56 are threaded shafts with nuts 51 holding the floats 50/52 at an adjustable height on the float shafts 54/56. In this way, with a simple tool, the operating depth (depth of the top rim 48 with respect to the liquid level 11 within the holding box 26) is easily adjusted. As shown, the float shafts 54/56 are interfaced with the movable riser 46 by two float cross members 60/62, although any number of cross members 60/62 are anticipated, including one. It is also anticipated that the floats 50/52 are also adjusted by bending of the float shafts 54/56 and or the float cross members 60/62.

Although the flow control system 40 is capable of supporting itself within the holding box 26, it is anticipated that one or more optional struts 44 are provided to secure the flow control system 20 to the holding box 26.

In some embodiments, a lock (not shown) is provided to lock the cover 28 on top of the holding box 26.

Figure 2:
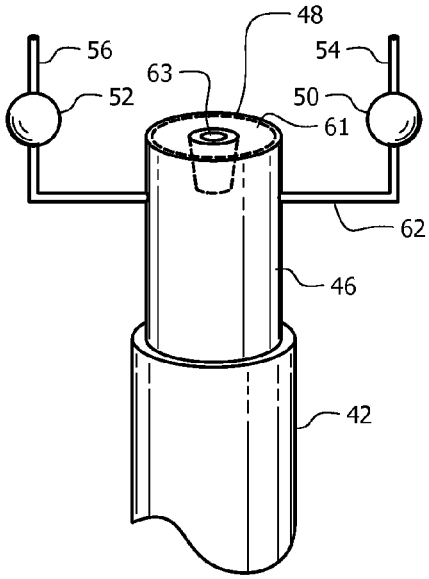
FIG. 2 illustrates a perspective view of the movable riser of a first embodiment of the present invention.

Referring to FIG. 2, a perspective view of the movable riser 46 of a first embodiment of the present invention will be described. For simplicity, the floats 50/52 are shown affixed to float shafts 54/56 and a single cross member 62, the cross member 62 holding the float shafts 54/56 to the movable riser 46. In such embodiments, the floats 50/52 are adjustable by bending of the float shafts 54/56 and/or the cross member 62 or by adjusting the vertical position of the floats 50/52 on the float shafts 54/56. Any number and/or shape of floats 50/52 are anticipated. Although shown throughout this description as spherical, other shapes of floats 50/52 are anticipated including square or rectangular boxes, etc.

There are many shapes and configurations for the top opening of the movable riser 46, one example of which is shown in FIG. 2. In this example, a movable riser top cover 61 has a nozzle 63. The nozzle 63 is smaller than the diameter of the movable riser 46, therefore, restricting the flow of water from the holding box 26 into the movable riser 46 and, hence, out of the drain pipe 24. Although shown as being circular in shape, any shape nozzle 63 is anticipated.

Figure 3:
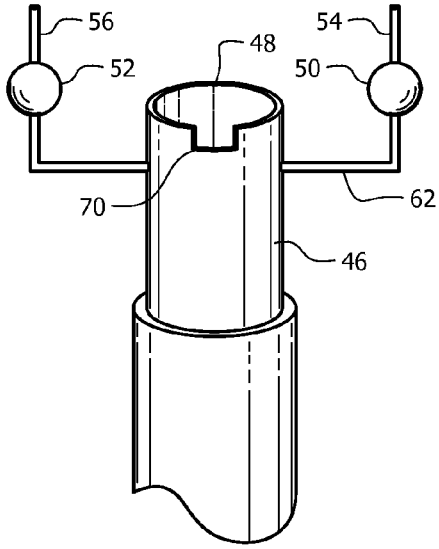
FIG. 3 illustrates a perspective view of the movable riser of a second embodiment of the present invention.

Referring to FIG. 3, a perspective view of the movable riser 46 of a second embodiment of the present invention will be described. For simplicity, the floats 50/52 are again shown affixed to float shafts 54/56 and a single cross member 62, the cross member 62 holding the float shafts 54/56 to the movable riser 46. In such embodiments, the floats 50/52 are adjustable by bending of the float shafts 54/56 and/or the cross member 62 or by adjusting the vertical position of the floats 50/52 on the float shafts 54/56. There are many edge shapes and configurations for the top rim of the movable riser 46, one example of which is shown in FIG. 3. In this example, a rectangular notch 70 is cut or formed on the rim 48 of the movable riser 46. The notch 70 provides a first flow of water from the holding box 26 into the movable riser 46 at a point at which the water level 11 rises above the bottom surface of the notch 70 and a second, greater flow of water from the holding box 26 into the movable riser 46 at a point at which the water level rises above the rim 48 of the movable riser 46. Although a single notch 70, rectangular in shape is shown, any number of notches 70 or any shape opening 70 is anticipated.

Figure 4:
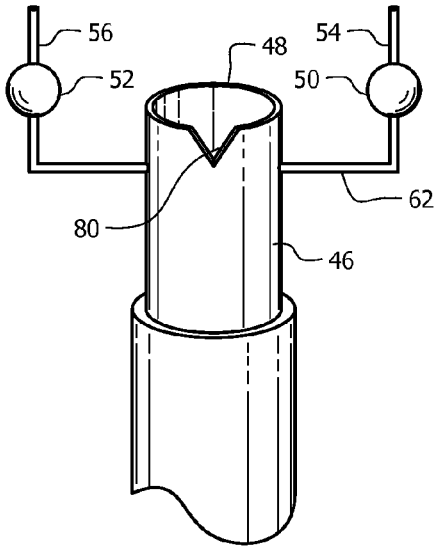
FIG. 4 illustrates a perspective view of the movable riser of a third embodiment of the present invention.
Figure 5:
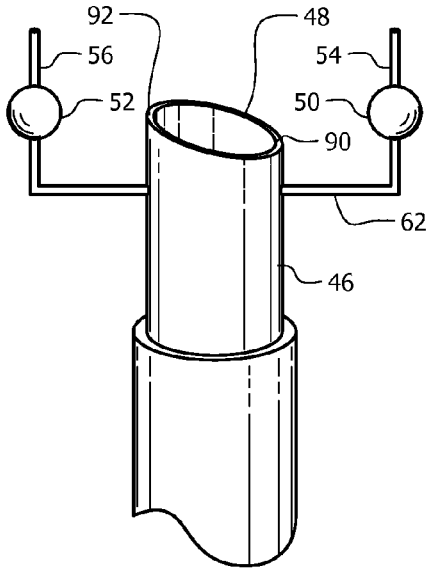
FIG. 5 illustrates a perspective view of the movable riser of a fourth embodiment of the present invention.

Referring to FIG. 4, a perspective view of the movable riser 46 of a third embodiment of the present invention will be described. For simplicity, the floats 50/52 are again shown affixed to float shafts 54/56 and a single cross member 62, the cross member 62 holding the float shafts 54/56 to the movable riser 46. In such embodiments, the floats 50/52 are adjustable by bending of the float shafts 54/56 and/or the cross member 62 or by adjusting the vertical position of the floats 50/52 on the float shafts 54/56. There are many edge shapes and configurations for the top rim of the movable riser 46, one example of which is shown in FIG. 4. In this example, a triangular notch 80 is cut or formed on the rim 48 of the movable riser 46. The notch 80 provides a gradually increased rate of flow of water from the holding box 26 into the movable riser 46 starting at a point at which the water level 11 rises above the bottom corner of the triangular notch 80 and increasing as the water level rises to a point equal to the rim 48 of the movable riser 46 at which point the water flow further increases as the water rises above the rim 48. Although shown as being triangular in shape, other opening shapes 80 are anticipated. Also, any number of notches 80 and/or notch 80 shapes is anticipated Referring to FIG. 5, a perspective view of the movable riser of a fourth embodiment of the present invention will be described. Again, for simplicity, the floats 50/52 are shown affixed to float shafts 54/56 and a single cross member 62, the cross member 62 holding the float shafts 54/56 to the movable riser 46. In such embodiments, the floats 50/52 are adjustable by bending of the float shafts 54/56 and/or the cross member 62 or by adjusting the vertical position of the floats 50/52 on the float shafts 54/56. There are many edge or rim 48 shapes and configurations for the top rim 48 of the movable riser 46, one example of which is shown in FIG. 5. In this example, the rim 48 of the movable riser 46 is sloped 90/92. The slope 90/92 provides a gradual and linear increased rate of water flow starting at a point at which the water level 11 rises above the lower point 90 of the rim 48, increasing until the water level rises to the top point 92 of the rim 48. Although shown as being a linear increase between the lower point 90 and the top point 92, any other slope and or stepping is anticipated. For example, the increase between the lower point 90 and the top point 92 is stepped at equal steps or is asymptotic.

Figure 6:
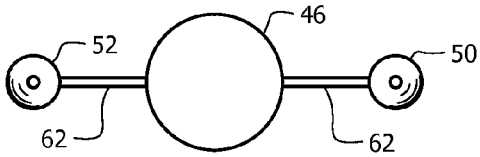
FIG. 6 illustrates a top plan view of a float system of the present invention.

Referring to FIG. 6, a top plan view of a float system of the present invention will be described. In this example, two floats 50/52 are attached to the movable riser 46 by cross members 62. It is anticipated that the cross member 62 is either affixed to the surface of the movable riser 46, passes through the movable riser 46 or is held by a bracket passing all or part way around the movable riser 46, as known in the industry.

Figure 7:
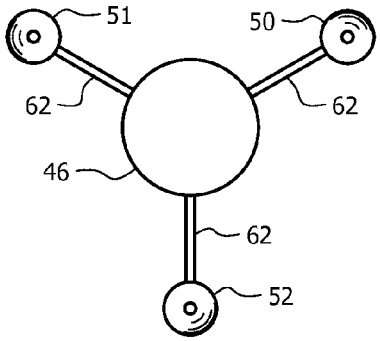
FIG. 7 illustrates a top plan view of an alternate float system of the present invention.

Referring to FIG. 7, a top plan view of an alternate float system of the present invention will be described. In this example, three floats 50/51/52 are attached to the movable riser 46 by cross members 62. It is anticipated that the cross member 62 is either affixed to the surface of the movable riser 46, passes through or part-way the movable riser 46 or is held by a bracket passing all or part way around the movable riser 46, as known in the industry. Although any number of floats 50/51/52 is anticipated, two or three floats 50/51/52 are preferred.

Figure 8:
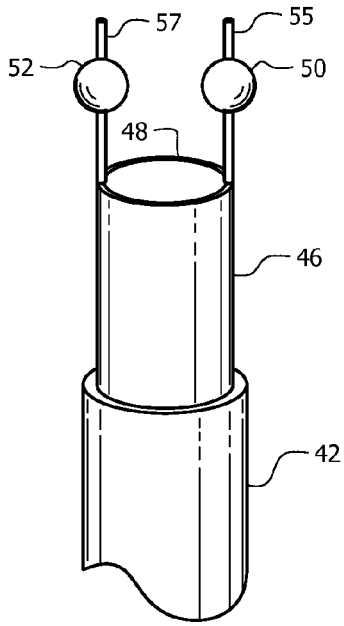
FIG. 8 illustrates a perspective view of another alternate float system of the present invention.

Referring to FIG. 8, a perspective view of another alternate float system of the present invention will be described. In this example, two floats 50/52 are attached to the movable riser 46 by the float shafts 55/57. It is anticipated that the float shafts 55/57 are either affixed to a surface of the movable riser 46 or are tapped/threaded into the movable riser 46, as known in the industry. Again, any number of floats 50/52 of any shape is anticipated.

Figure 9:
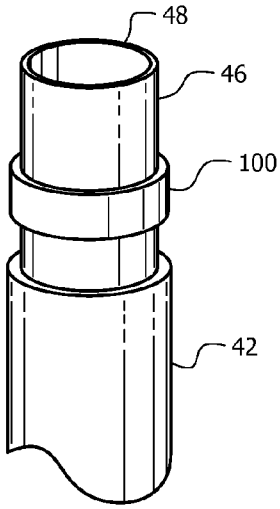
FIG. 9 illustrates a perspective view of another alternate float system of the present invention.

Referring to FIG. 9, a perspective view of another alternate float system of the present invention will be described. In this example, the float 100 surrounds or is directly affixed to the outside of the movable riser 46. Although shown as a single float 100 affixed to the entire circumference of the movable riser 46, it is also anticipated that the float 100 is in sections, each affixed to the outer circumference of the movable riser 46. In this embodiment, the float is, for example, a Styrofoam ring or balloon filled with a gas that has a specific gravity of less than 1. It is anticipated that, in some embodiments, the float 100 is slideably affixed to the movable riser 46, such that, the float 100 is repositionable either closer to or further away from the rim 48, thereby adjusting the average liquid height above the rim 48. It is also anticipated that, in embodiments in which the float 100 is a balloon filled with a gas, the inflation volume is adjustable, also adjusting the average liquid height above the rim 48.

Figure 10:
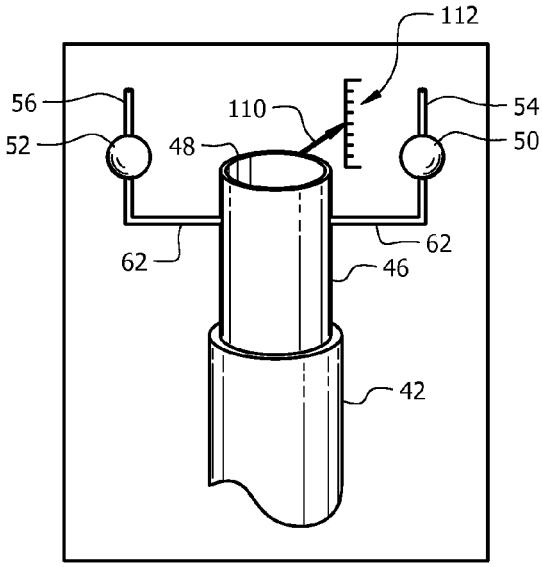
FIG. 10 illustrates a perspective view of an alternate embodiment of the present invention.

Referring to FIG. 10, a perspective view of an alternate embodiment of the present invention will be described. In this example, a pointer or scribe 110 is affixed to the movable riser 46 and set to aim at a gradient 112, providing a means for helping the site engineer to properly adjust the floats 50/51/52/100 based upon the desired discharge rate.

Figure 11:
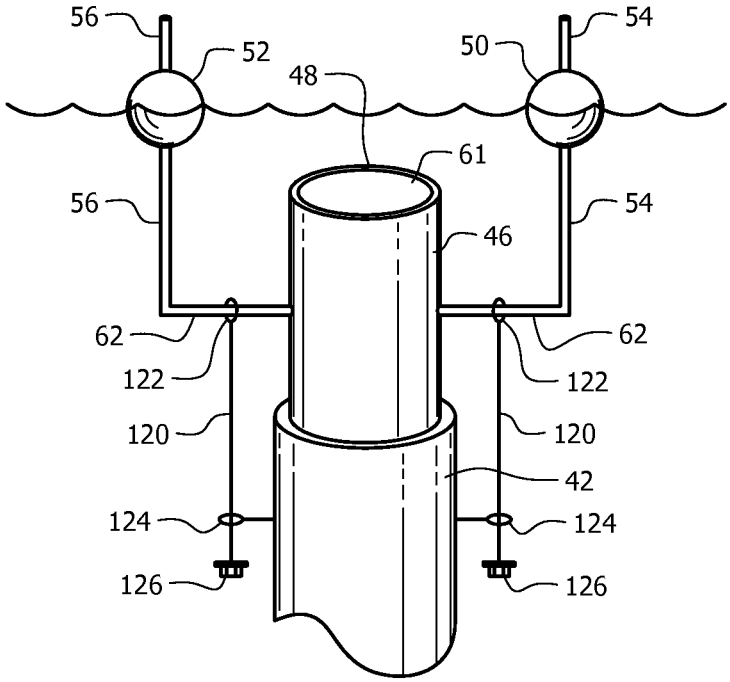
FIG. 11 illustrates a perspective view of another alternate embodiment of the present invention.

Referring to FIG. 11, a perspective view of another alternate embodiment of the present invention will be described. This shows an exemplary way to restrict the rise of the movable riser 46 when there is no surface above the float rods 54/56 to restrict the height of travel of the movable riser 46. In this, one or more arms 120 are affixed to the cross members 62 by, for example, by loop(s) 122. The arm(s) 120 freely pass within an eye 124 or eyes 124 or other similar structures and there is a stop 126 at the bottom end of the arm(s) 120 such that, as the movable riser 46 lifts to a predetermined limit, the stop(s) 126 prevent the movable riser 46 from raising any further than allowed by the stop(s) 126 and the length of the arm(s) 120. It is anticipated that the stop(s) 126 are adjustable along the length of the arm(s) 120, providing an adjustable maximum height of travel for the movable riser 46.

Figure 12:
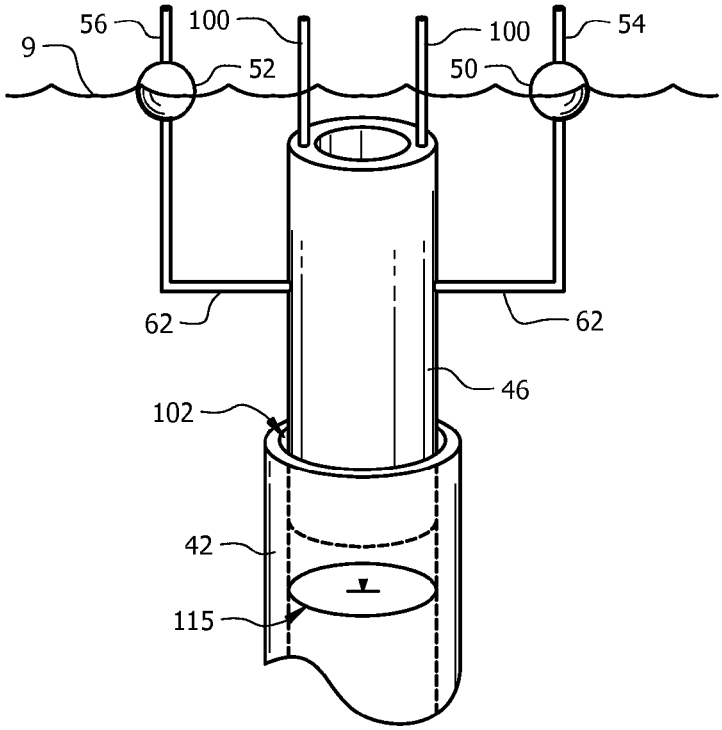
FIG. 12 illustrates a perspective view of an alternate embodiment of the present invention.

Referring to FIG. 12, a perspective view of an alternate embodiment of the present invention will be described. In this embodiment, the top rim 48 of the movable riser 46 is below the surface of the liquid 9, held by floats 50/52 on supports 54/56/62. In this example, there is also a noticeable interstitial space 102 between the stationary riser 42 and the movable riser 46. The liquid flows over the top rim 48 of the movable riser 46 and eventually out through the drainage system 24 (see FIG. 1). The liquid also flows out through the interstitial space or gap 102 between the movable riser 46 and the stationary riser 42. Since the movable riser 46 rises in response to the fluid level 9, and the top rim 48 of the movable riser 46 is maintained at a constant depth with respect to the fluid level 9, the flow rate through the movable riser 46 is constant as long as air is allowed to enter the movable riser 46 through one or more air vent tubes 100 when the drainage system 24 (see FIG. 1) is surcharged and not otherwise operating under open channel flow conditions. In some embodiments, instead of independent air vent tubes 100, the supports 54/56/62 are hollow, venting air into the movable riser 46. Since the restriction to flow through the interstitial space or gap 102 is fixed at the top edge of the stationary riser 42, the flow rate through the interstitial space 102 is variable with respect to the fluid level 9; where the degree of variability in the flow rate is a function of the cross sectional area of the interstitial space or gap 102. The liquid level 115 in the drainage system 24 and stationary riser 42 is lower than the bottom of the movable riser 46.

Figure 13:
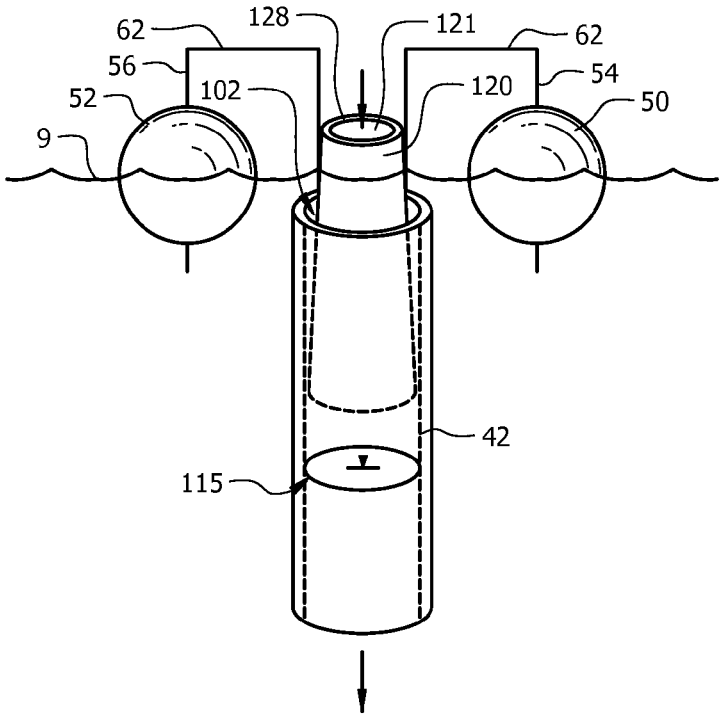
FIG. 13 illustrates a perspective view of an alternate embodiment of the present invention.

Referring to FIG. 13, a perspective view of an alternate embodiment of the present invention will be described. In this embodiment, the drainage system 24 (see FIG. 1) is surcharged (i.e. not operating under open channel flow conditions) and the top rim 128 of the movable riser 120 is held above the surface of the liquid 9 by floats 50/52 on supports 54/56/62. In this example, there is also a noticeable interstitial space 102 between the stationary riser 42 and the movable riser 120. The liquid flows through the interstitial space or gap 102 between the stationary riser 42 and the movable riser 120. Since the movable riser 120 rises in response to the fluid level 9, the bottom edge of the movable riser 120 is maintained at a constant depth with respect to the fluid level 9 and, therefore, the flow rate is constant through the interstitial space 102 since air is allowed to enter the movable riser 120 through a central opening 121. The diameter of the movable riser 120 gradually decreases towards the top such that the restriction to flow through the interstitial space or gap 102 is maintained at the bottom edge of the movable riser 120. The liquid level 115 in the drainage system 24 and stationary riser 42 is lower than the bottom of the movable riser 46.

Figure 14:
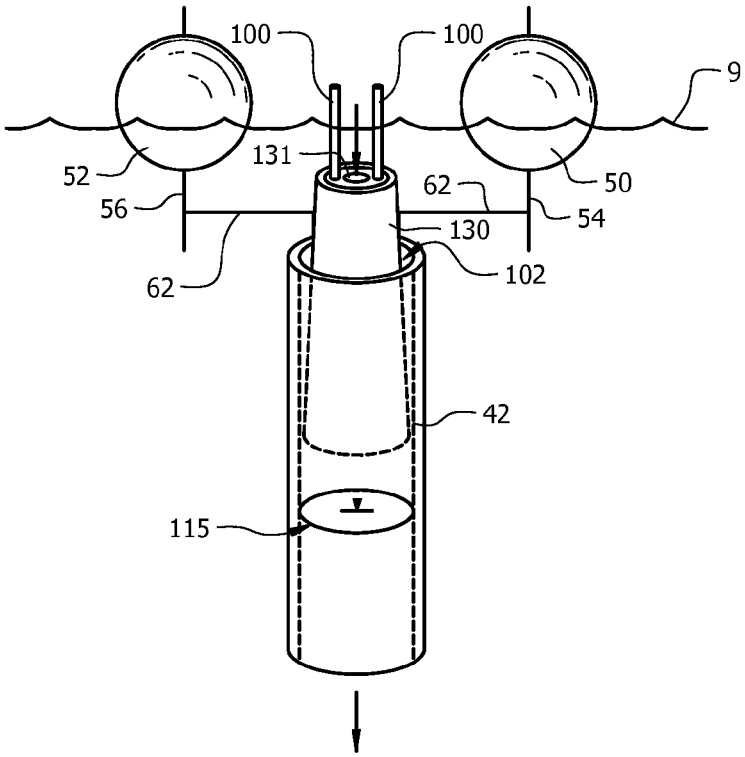
FIG. 14 illustrates a perspective view of an alternate embodiment of the present invention.

Referring to FIG. 14, a perspective view of an alternate embodiment of the present invention will be described. In this embodiment, the drainage system 24 (see FIG. 1) is surcharged (i.e. not operating under open channel flow conditions) and the orifice or opening 131 of the movable riser 130 is held below the surface of the liquid 9, by floats 50/52 on supports 54/56/62. In this example, there is also a noticeable interstitial space 102 between the stationary riser 42 and the movable riser 130. The liquid flows into the orifice or opening 131 of the movable riser 130 and eventually out through the drainage system 24 (see FIG. 1). The liquid also flows out through the interstitial space or gap 102. Since the movable riser 130 rises in response to the fluid level 9, the bottom edge of the movable riser 46 is maintained at a constant depth with respect to the fluid level 9 and, therefore, the flow rate is constant, both through the orifice/opening 131 of the movable riser 130 and through the interstitial space 102 since air is allowed to enter the movable riser 130 through one or more air vent tubes 100. In some embodiments, instead of independent air vent tubes 100, the supports 54/56/62 are hollow, venting air into the movable riser 46. The diameter of the movable riser 130 gradually decreases towards the top such that the restriction to flow through the interstitial space or gap 102 is maintained at the bottom edge of the movable riser 130. The liquid level 115 in the drainage system 24 and stationary riser 42 is lower than the bottom of the movable riser 130.

Figure 15:
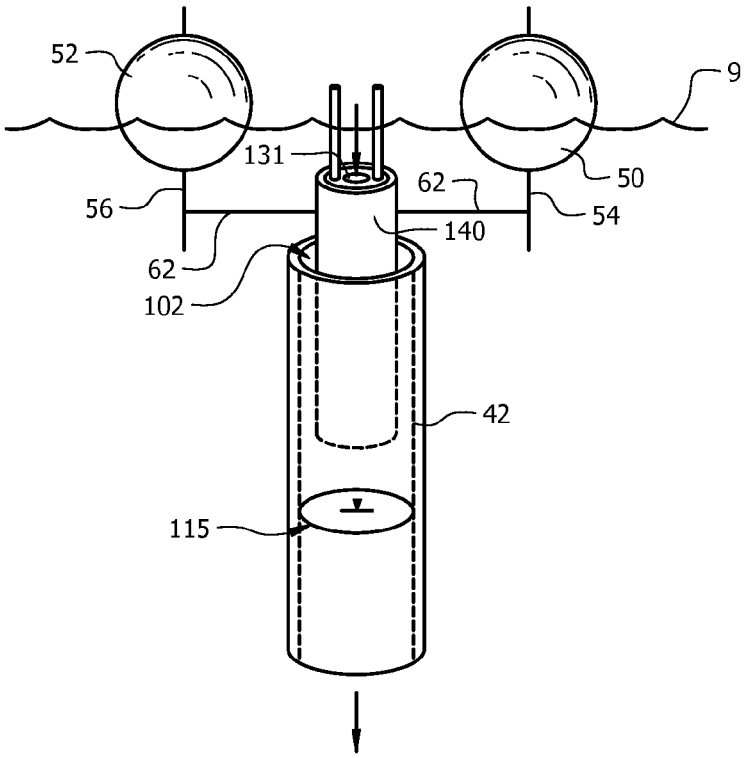
FIG. 15 illustrates a perspective view of an alternate embodiment of the present invention.

Referring to FIG. 15, a perspective view of an alternate embodiment of the present invention will be described. In this embodiment, the drainage system 24 (see FIG. 1) is surcharged (i.e. not operating under open channel flow conditions) and the orifice 141 of the movable riser 140 is held below the surface of the liquid 9, by floats 50/52 on supports 54/56/62. In this example, there is also a noticeable interstitial space 102 between the stationary riser 42 and the movable riser 140. The liquid flows into the orifice 141 of the movable riser 140 and eventually out the drainage system 24 (see FIG. 1). The liquid also flows out through the interstitial space or gap 102. Since the movable riser 140 rises in response to the fluid level 9, the flow rate is constant both through the orifice 141 of the movable riser 140 and through the interstitial space 102 and because air enters into the movable riser 140. Since the diameter of the movable riser 140 is constant along its length and the interstitial space or gap 102 has a uniform cross sectional area, the restriction to flow through the interstitial space or gap 102 is fixed at the rim of the stationary riser 42 and the flow rate through the interstitial space or gap 102 is variable with respect to fluid level 9 where the degree of variability is a function of the cross sectional area of the interstitial space or gap 102. The liquid level 115 in the drainage system 24 and stationary riser 42 is lower than the bottom of the movable riser 140.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A flow control system for integration into a detention pond, the flow control system comprising:

a stationary riser, the stationary riser having a stationary riser hollow core, an axis of the stationary riser hollow core being vertical, the stationary riser hollow core fluidly connected to a drainage system;

a movable riser, the movable riser slideably interfaced with the stationary riser, the movable riser having a hollow core, an axis of the hollow core being vertical, a top surface of the movable riser having an opening, the hollow core fluidly connected to the stationary riser hollow core whereas liquid from the detention pond flows through the opening, through the hollow core through the stationary riser hollow core and out of the stationary riser hollow core and into the drainage system;

at least one vent tube, a first end of the vent tubes positioned above the liquid of the detention ponds and a second end of the vent tubes venting the movable riser hollow core, thereby equalizing air pressure between an atmosphere above the detention pond and an air pressure within the movable riser hollow core; and at least one float interfaced to the movable riser, the at least one float providing buoyancy to the movable riser.

2. The flow control system of claim 1, wherein the movable riser has an outer dimension and the stationary riser hollow core has an inner dimension and the outer dimension is smaller than the inner dimension, slideably holding the movable riser within the stationary riser hollow core, thereby the liquid also flows through the gap between the movable riser and the stationary riser and into the drainage system.

3. The flow control system of claim 1, wherein the movable riser has a constant cross section, thereby resulting in a varying flow rate.

4. The flow control system of claim 1, wherein cross-sectional dimensions of the opening is equivalent to cross-sectional dimensions of the hollow core of the movable riser.

5. The flow control system of claim 1, wherein cross-sectional dimensions of the opening is smaller than cross-sectional dimensions of the hollow core of the movable riser.

6. The flow control system of claim 1, wherein the at least one float consists of two buoyant members interfaced to the movable riser by shafts.

7. The flow control system of claim 6, wherein the at least one vent tube is integrated into the shafts.

8. A flow control system for integration into a detention pond, the flow control system comprising:

a holding box, the holding box installed in a bed of the detention pond, the holding box having an interior cavity and an opening in communication with liquid contained in the detention pond;

a stationary riser positioned within the holding box, the stationary riser having a stationary riser hollow core, an axis of the stationary riser hollow core being vertical, the stationary riser hollow core fluidly connected to a drainage system;

a movable riser, the movable riser slideably interfaced with the stationary riser, the movable riser having a hollow core, an axis of the hollow core being vertical, a top surface of the movable riser having an opening, the hollow core fluidly connected to the stationary riser hollow core whereas liquid from the detention pond flows into the opening and through the hollow core and through the stationary riser hollow core and into the drainage system;

at least one vent tube, a first end of the vent tubes positioned above the liquid of the detention ponds and a second end of the vent tubes venting the movable riser hollow core, thereby equalizing air pressure between an atmosphere above the detention pond and an air pressure within the movable riser hollow core; and at least one float interfaced to the movable riser, the at least one float providing buoyancy to the movable riser.

9. The flow control system of claim 8, wherein the movable riser has an outer dimension and the stationary riser hollow core has an inner dimension and the outer dimension is smaller than the inner dimension, slideably holding the movable riser within the stationary riser hollow core, thereby the liquid also flows through the gap between the movable riser and the stationary riser and into the drainage system.

10. The flow control system of claim 8, wherein the movable riser has a constant cross section, thereby resulting in a varying flow rate.

11. The flow control system of claim 8, wherein cross-sectional dimensions of the opening is equivalent to cross-sectional dimensions of the hollow core of the movable riser.

12. The flow control system of claim 8, wherein cross-sectional dimensions of the opening is smaller than cross-sectional dimensions of the hollow core of the movable riser.

13. The flow control system of claim 8, wherein the at least one float consists of two buoyant members interfaced to the movable riser by shafts.

14. The flow control system of claim 13, wherein the at least one vent tube is integrated into the shafts.

15. A flow control system for integration with a detention pond, the flow control system comprising:

a stationary riser, the stationary riser having a stationary riser hollow core, an axis of the stationary riser hollow core being vertical, the stationary riser hollow core having an inner dimension, the stationary riser hollow core fluidly connected to a drainage system;

a movable riser, the movable riser slideably interfaced within the stationary riser hollow core, the movable riser having a hollow core, the movable riser hollow core fluidly coupled to the stationary riser hollow core, the movable riser having an outer dimension and the outer dimension of the movable riser is smaller than the inner dimension of the stationary riser, slideably holding the movable riser within the stationary riser hollow core, a gap between the stationary riser and the movable riser, whereby the liquid flows through the gap between the movable riser and the stationary riser and into the drainage system;

at least one float interfaced to the movable riser, the at least one float providing buoyancy to the movable riser holding a top rim of the movable riser above a liquid level of the detention pond; and an opening in the top surface of the movable riser equalizing air pressure between an atmosphere above the detention pond and an air pressure within the movable riser hollow core.

16. The flow control system of claim 15, wherein the movable riser has a constant cross section, thereby resulting in a varying flow rate.

17. The flow control system of claim 15, wherein the opening has the same dimension as a dimension of the hollow core of the movable riser.

18. The flow control system of claim 15, wherein cross-sectional dimensions of the opening is equivalent to cross-sectional dimensions of the hollow core of the movable riser.

19. The flow control system of claim 15, wherein cross-sectional dimensions of the opening is smaller than cross-sectional dimensions of the hollow core of the movable riser.

* * * * *